US005894776A

United States Patent [19]

Bartz

[11] Patent Number: 5,894,776

[45] Date of Patent: Apr. 20, 1999

[54] TABLE SAW TOP AND MITRE BAR

[76] Inventor: William R. Bartz, 152 Park Rd., Two Rivers, Wis. 54241

[21] Appl. No.: 08/665,958

[22] Filed: Jun. 17, 1996

Related U.S. Application Data

[63] Continuation-in-part of application No. 08/583,741, Jan. 17, 1996, abandoned.

[51] Int. Cl.[6] ..... B26D 7/06

[52] U.S. Cl. ..... 83/435.11; 83/437.1; 83/821

[58] Field of Search ..... 83/435.11, 435.12, 83/435.13, 435.14, 442, 437.1, 477.2, 468.3, 454, 574, 821; 33/464, 640, 470, 472, 473

[56] References Cited

U.S. PATENT DOCUMENTS

| | | | |
|---|---|---|---|
| 2,621,411 | 12/1952 | Christen | 33/464 |
| 2,968,325 | 1/1961 | Wandvik . | |
| 3,101,550 | 8/1963 | Helferich | 33/464 |
| 4,872,249 | 10/1989 | VanderPol et al. | 83/574 |
| 5,275,074 | 1/1994 | Taylor et al. | 83/435.11 |
| 5,379,669 | 1/1995 | Roedig | 83/435.14 |
| 5,491,906 | 2/1996 | Reilly | 33/640 |

*Primary Examiner*—Kenneth E. Peterson
*Attorney, Agent, or Firm*—Joseph Smith

[57] ABSTRACT

A combination tablesaw top and mitre bar is provided which eliminates the play encountered in previous systems. In addition the manufacturing tolerances are much relaxed, leading to reduced cost and little if no operator adjustment. In a preferred embodiment, the tablesaw has a flat top with a groove therein extending substantially across the top, the groove having a top and a bottom, wherein the groove has a cross-section which is wider at the top than at a point below the top. The mitre bar for use with the tablesaw has a top and a bottom, and a cross-section such that the top of the mitre bar is larger in dimension than the lateral dimension of the bottom of the mitre bar, but the top of the mitre bar is smaller in dimension than the top of the tablesaw groove. This relationship between the groove and the mitre bar is provided such that the mitre bar will sit down into the groove without extending above the tablesaw top. Several preferred embodiments are described.

21 Claims, 12 Drawing Sheets

Dissimilar Angles

TABLE SAW TOP AND MITRE BAR

CROSS REFERENCE TO RELATED APPLICATION

This is a continuation-in-part of application Ser. No. 08/583,741, filed Jan. 17, 1996, now abandoned.

FIELD OF THE INVENTION

The present invention is in the field of mitre guides and mitre bars for table saws, and in particular relates to a new mitre bar which provides for a much more precise guide for saw cuts.

BACKGROUND OF THE INVENTION

When cutting a piece of material at a selected angle on a table saw, there is always a significant problem in achieving enough angular precision, e.g. to ensure a proper angle for tight joints. This problem has been addressed in a number of ways, for example as seen in the following U.S. patents: U.S. Pat. No. 4,454,793, issued June 1984, which relates to an attachment for a mitre gauge; U.S. Pat. No. 2,968,325, which relates to a table saw guide frame; U.S. Pat. No. 5,042,346, which relates to apparatus for fabricating accurate mitered corners; U.S. Pat. No. 4,165,668, which relates to a mitre gauge; and U.S. Pat. No. 5,275,074 which relates to a mitre slider.

In order to understand the nature of the problem, FIG. 1 is provided to show a typical plan view of a conventional table saw 11. Saw 11 typically has two parallel grooves 13 and 15 for restraining a miter guide 17 to be moved in a direction parallel to the groove. Miter guide 17 has a rotatably adjustable guide element 20 with a support surface 10 for setting the angle by which a piece to be cut is presented to the cutting element, in this case saw blade 23. Adjustable element 20 is pivoted on bar 18, which is configured to slide in groove 13. A hand-operated clamp nut assembly 19 also attaches to bar 18 at a different point than the pivot. By loosening clamp nut 19, rotating element 20, and tightening the nut, a user can adjust the miter to change the angle of the cut.

FIG. 2 shows a cross-sectional view of top 12 of table saw 11, and its relationship to mitre bar 18, and groove 13. As illustrated, in the typical table saw, the groove is rectangular in cross-section and the so is the mitre bar. In order to allow for ease of motion and to avoid the expense of creating bars and grooves with exacting tolerances, there is typically a significant gap between the bar and the groove, e.g. of the order of one-sixteenth of an inch. This "play", however, is a significant source of imprecision in consistently cutting desired angles with the saw, since the lateral motion of the bar in the guide changes the angle of the cut.

This lateral play problem is addressed specifically in U.S. Pat. No. 5,275,074 cited above. In that patent, however, the groove serves as a repository for a precision-shaped insert, and a mated bar is attached thereto. Although that apparatus does specifically address the problem, it is a very expensive, and requires adjustment by the operator to a achieve the appropriate sliding motion.

What is needed is a solution to the lateral play problem which is both inexpensive and requires a minimum of operator adjustment.

SUMMARY OF THE INVENTION

In accordance with preferred embodiments of the invention, a combination tablesaw top and mitre bar is provided which eliminates the play encountered in previous systems. In addition the manufacturing tolerances are much relaxed, leading to reduced cost and little if no operator adjustment.

In a preferred embodiment, the tablesaw has a flat top with a groove therein extending substantially across the top, the groove having a top and a bottom, wherein the groove has a cross-section which is wider at the top than at a point below the top. The mitre bar for use with the tablesaw has a top and a bottom, and a cross-section such that the top of the mitre bar is larger in dimension than the lateral dimension of the bottom of the mitre bar, but the top of the mitre bar is smaller in dimension than the top of the tablesaw groove. This relationship between the groove and the mitre bar is provided such that the mitre bar will sit down into the groove without extending above the tablesaw top. The mitre bar is configured to contact the groove along at least one straight line running the length of the groove.

In the preferred mode, the mitre bar is configured to contact the groove along a second straight line running the length of the groove which is parallel to said at least one straight line. Also, in the preferred mode, the mitre bar contacts the at least one straight line and the second straight line at the top of the mitre bar. In additional embodiments, the groove has a cross-section which is trapezoidal in shape. In another embodiment, the mitre bar also has a cross-section which is trapezoidal shape. In another embodiment the mitre bar has a cross-section which is a segment on a chord of a circle. In yet another embodiment, the groove has a cross-section which is a segment on a chord of a circle, and in additional embodiment a mitre bar is used with this groove which also has a cross-section which is a segment on a chord of a second circle, wherein the second circle has a larger diameter than said circle. In a further embodiment, the mitre bar has a substantially rectangular cross-section, with the bottom corners rounded. The groove to be used with that bar has vertically descending sides as for a normal mitre groove, but the sides are angled in near the bottom to engage the rounded corners of the mitre bar. Various other combinations are also disclosed.

In other embodiments, individual mitre bars are provided which have various cross-sections, for example, triangular, trapezoidal, and a segment on the chord of a circle.

In yet another embodiment, an insert is provided which can be used with a standard rectangular groove in a tablesaw top in order to adapt the tablesaw top to accept one of the mitre bars according to the invention.

BRIEF DESCRIPTION OF THE FIGURES

Shown in FIG. 1 is a typical prior art tablesaw top and mitre bar combination.

Shown in FIG. 2 is a cross-sectional view of the top shown in FIG. 1 and its relationship to a mitre bar used therewith.

Figure 3:
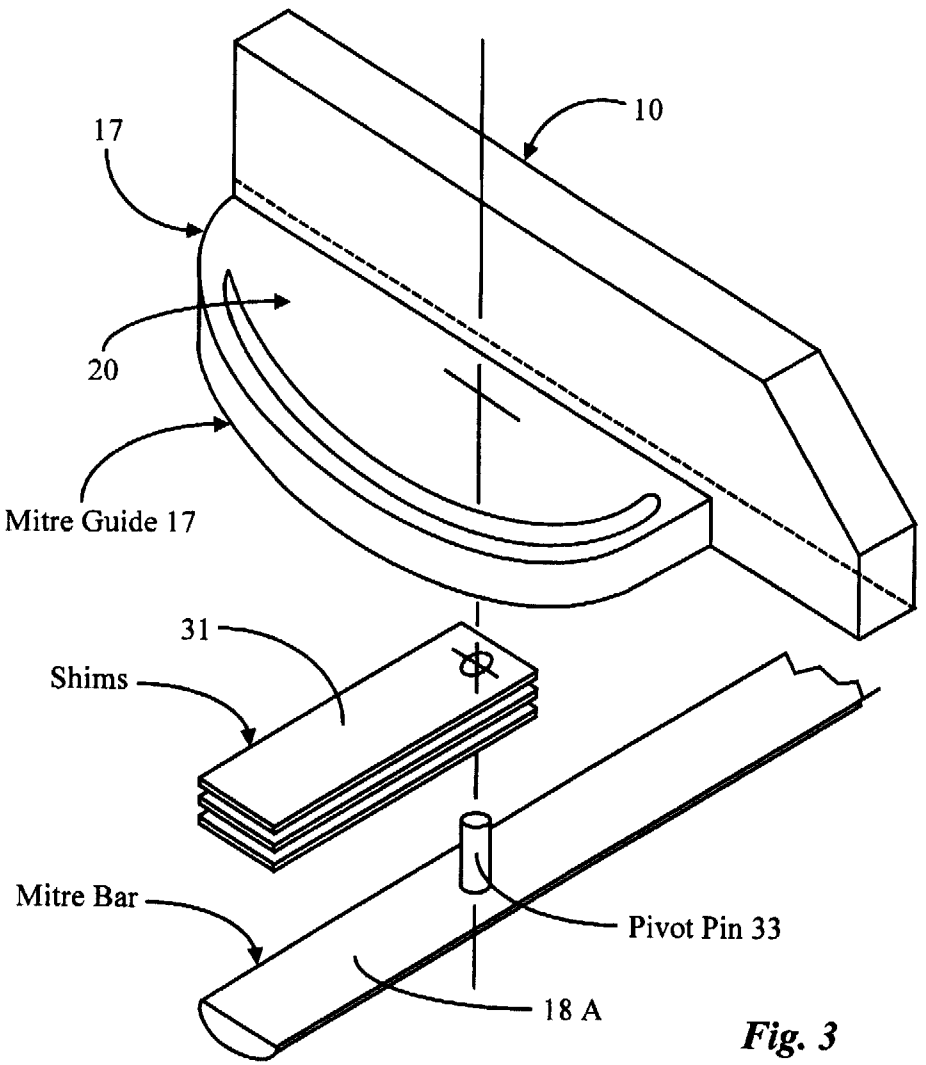

Shown in FIG. 3 is an expanded view of a mitre bar and mitre guide combination in accordance with a first embodiment of the invention.

Figure 4:
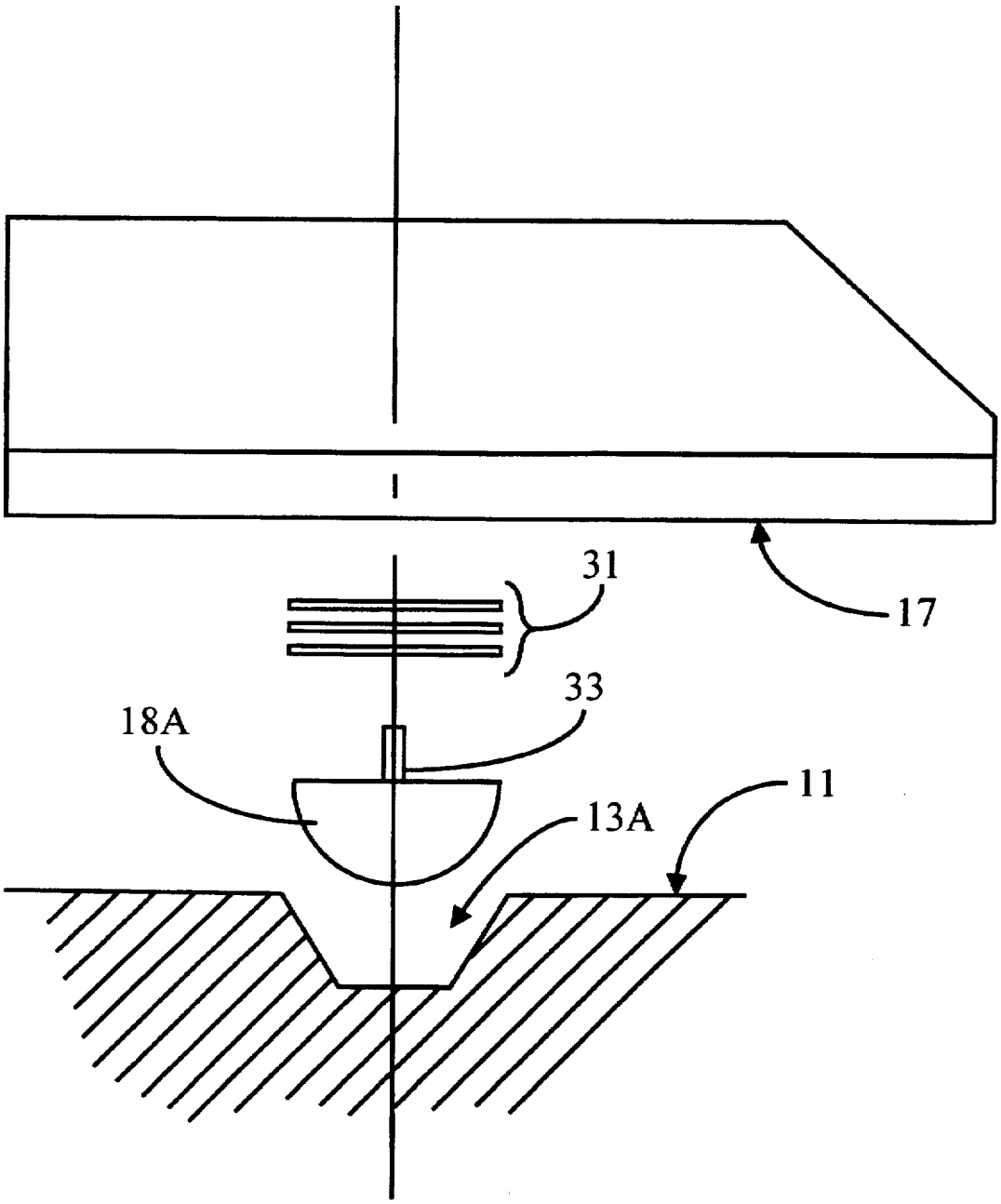

Shown in FIG. 4 is an expanded cross-sectional view of the mitre bar and mitre guide combination shown in FIG. 3 and a mitre groove in a tablesaw top.

Figure 5:
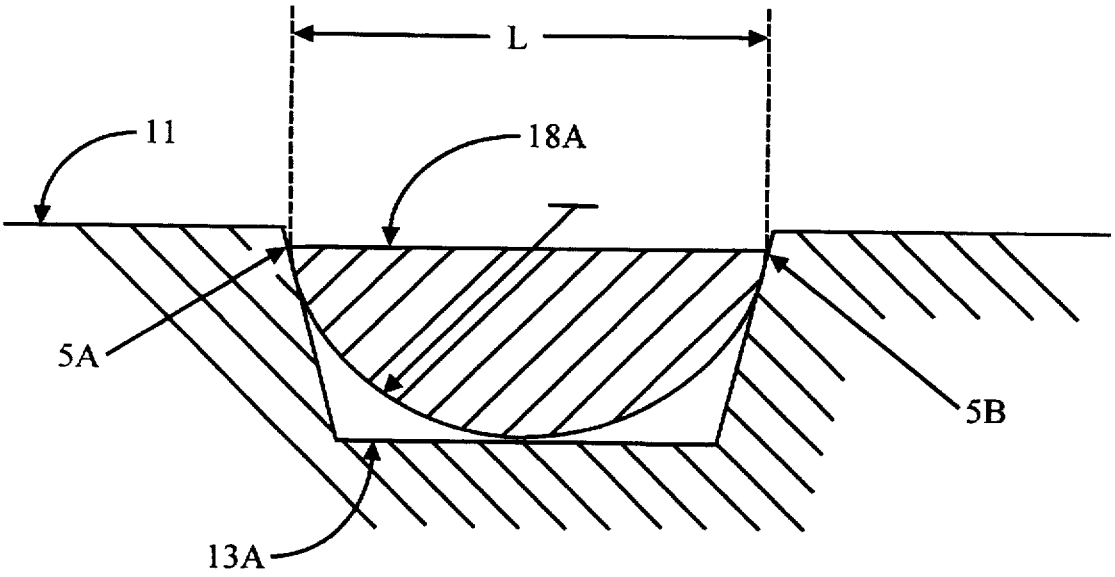

Shown in FIG. 5 is a cross-sectional view of the mitre bar and tablesaw top shown in FIGS. 3 and 4 illustrating the position of the mitre bar relative to the mitre groove when the mitre bar is in use.

Figure 6:
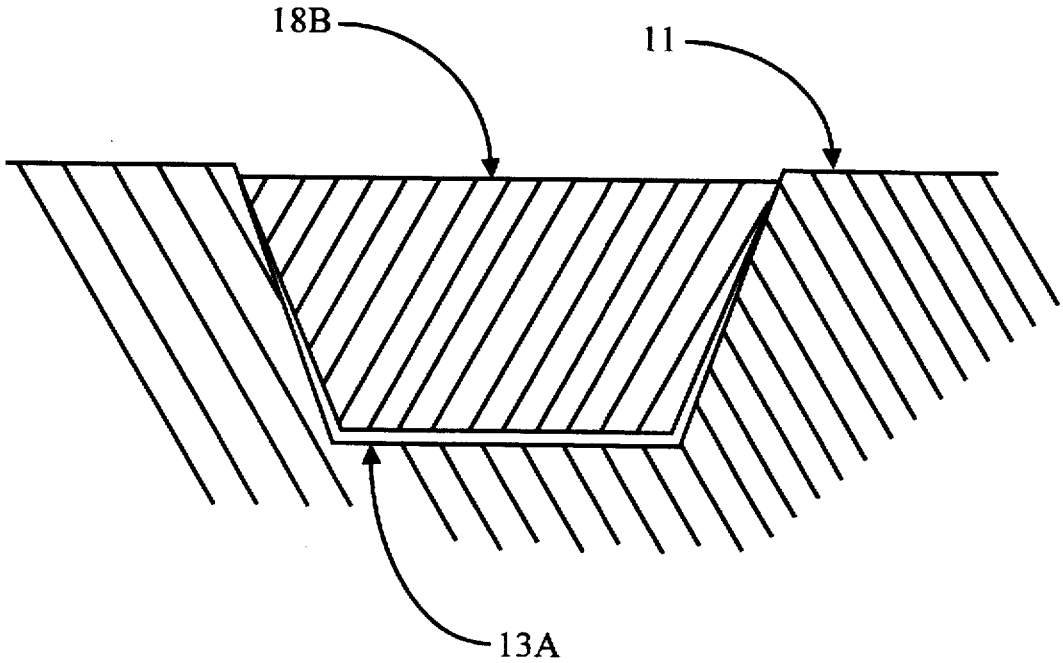

Shown in FIG. 6 is an alternative preferred embodiment of a mitre groove in accordance with the invention.

Figure 7:
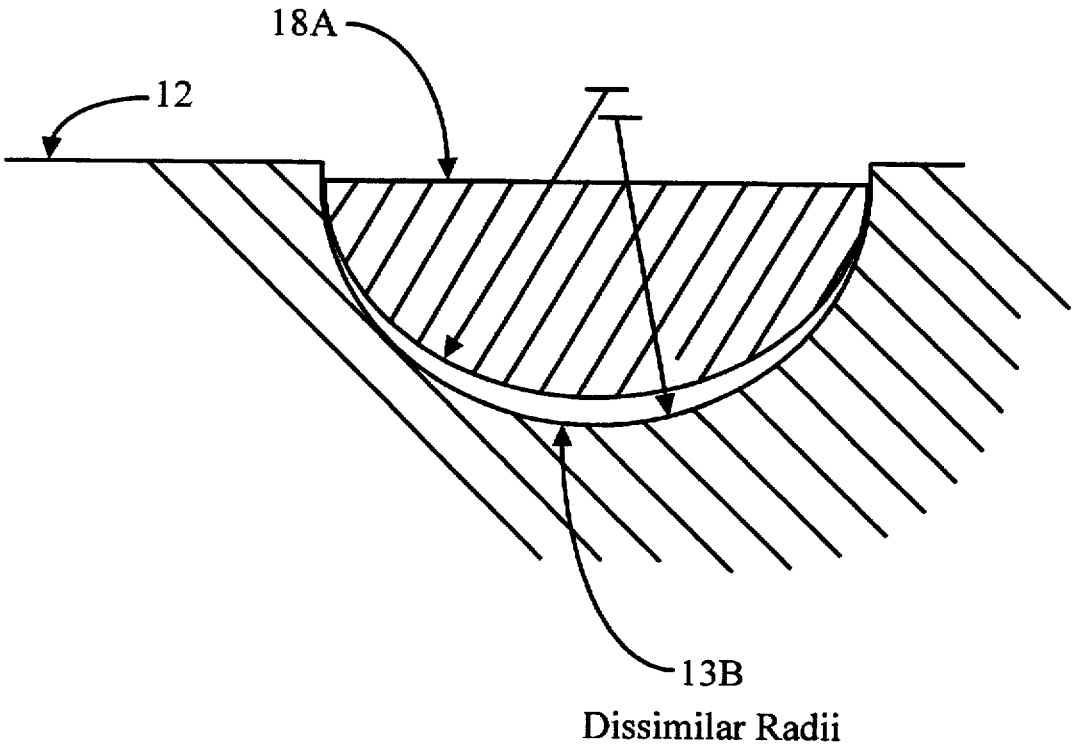

Shown in FIG. 7 is another alternative embodiment of a mitre groove and mitre bar combination in accordance with the invention.

Figure 8A:
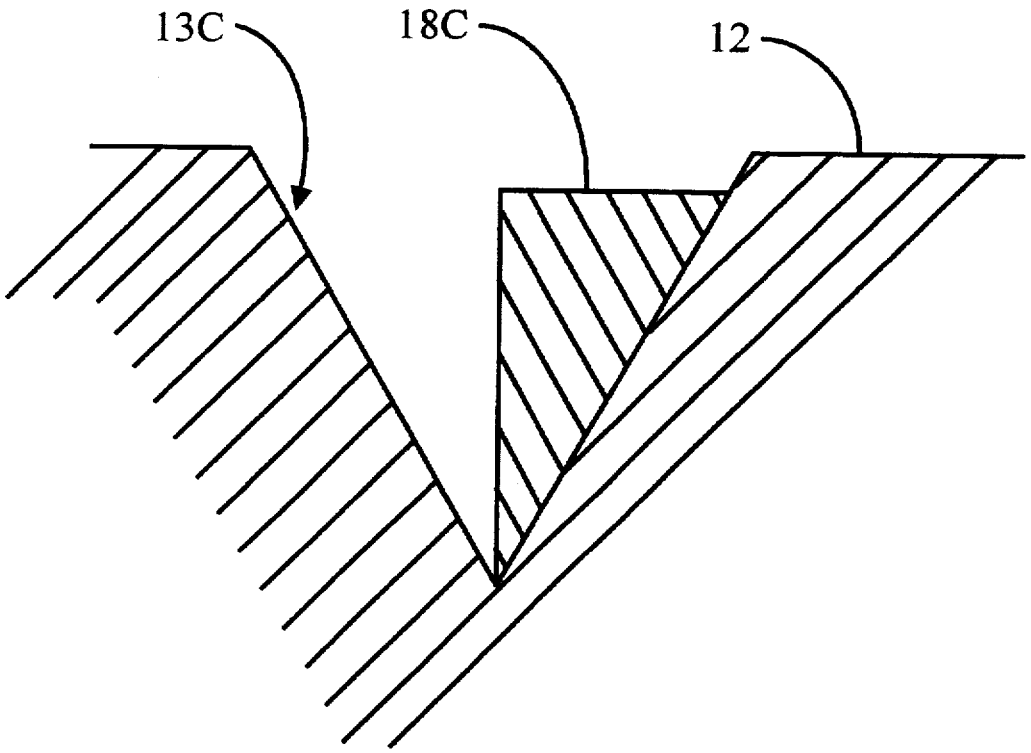

Shown in FIG. 8A is another alternative embodiment of a mitre groove and mitre bar combination in accordance with the invention, which uses a groove having a triangular cross-section.

Figure 8B:
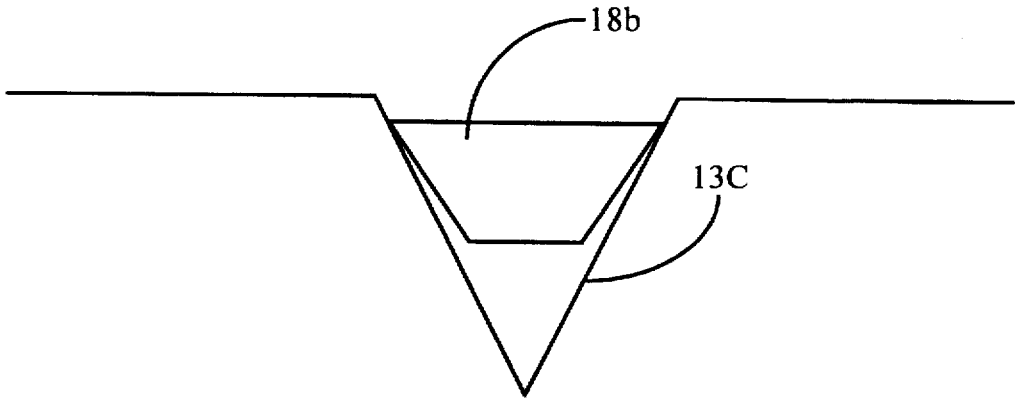

Shown in FIG. 8B is another alternative embodiment of the mitre groove of FIG. 8A and a trapezoidal mitre bar in combination in accordance with the invention.

Figure 8C:
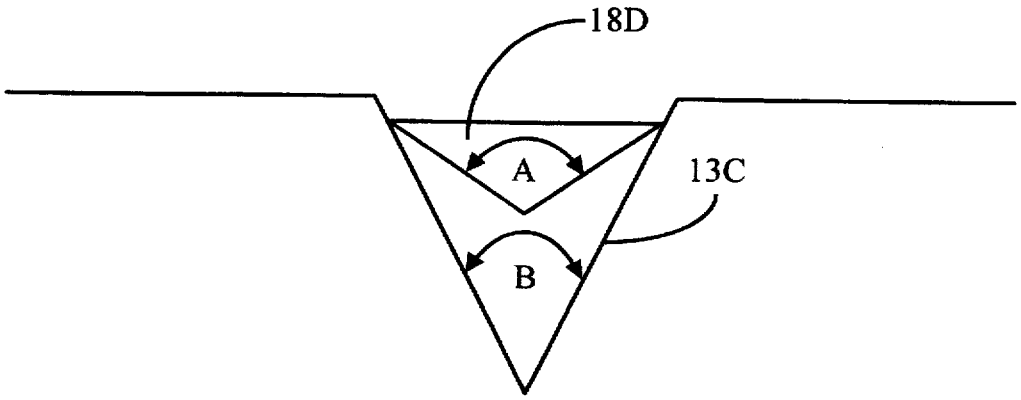

Shown in FIG. 8C is yet another alternative embodiment of the mitre groove of FIG. 8A and triangular mitre bar combination in accordance with the invention.

Figure 9:
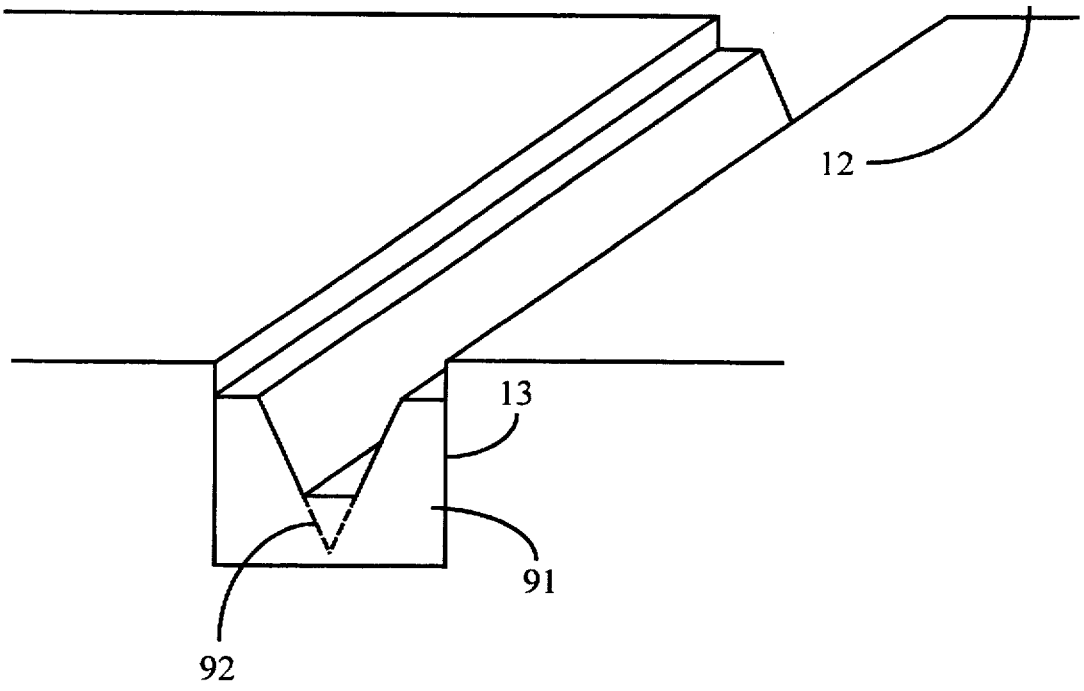

Shown in FIG. 9 are two alternative embodiments of a mitre groove insert in accordance with the invention.

Figure 10:
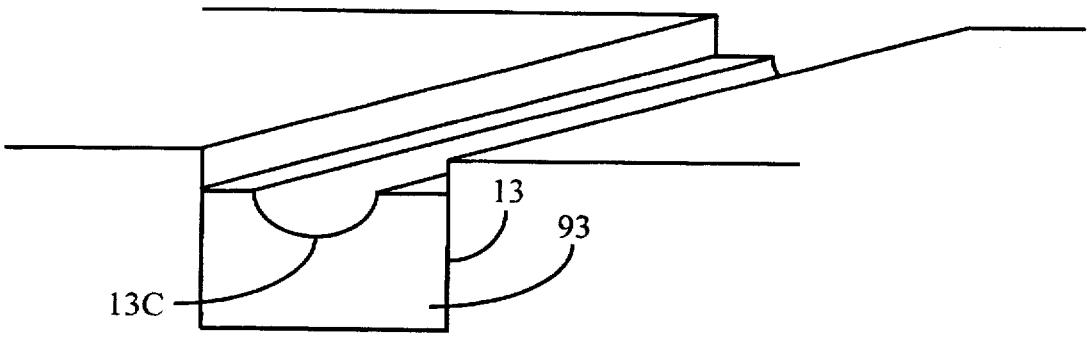

Shown in FIG. 10 is another mitre groove insert in accordance with preferred embodiments of the invention.

Figure 11:
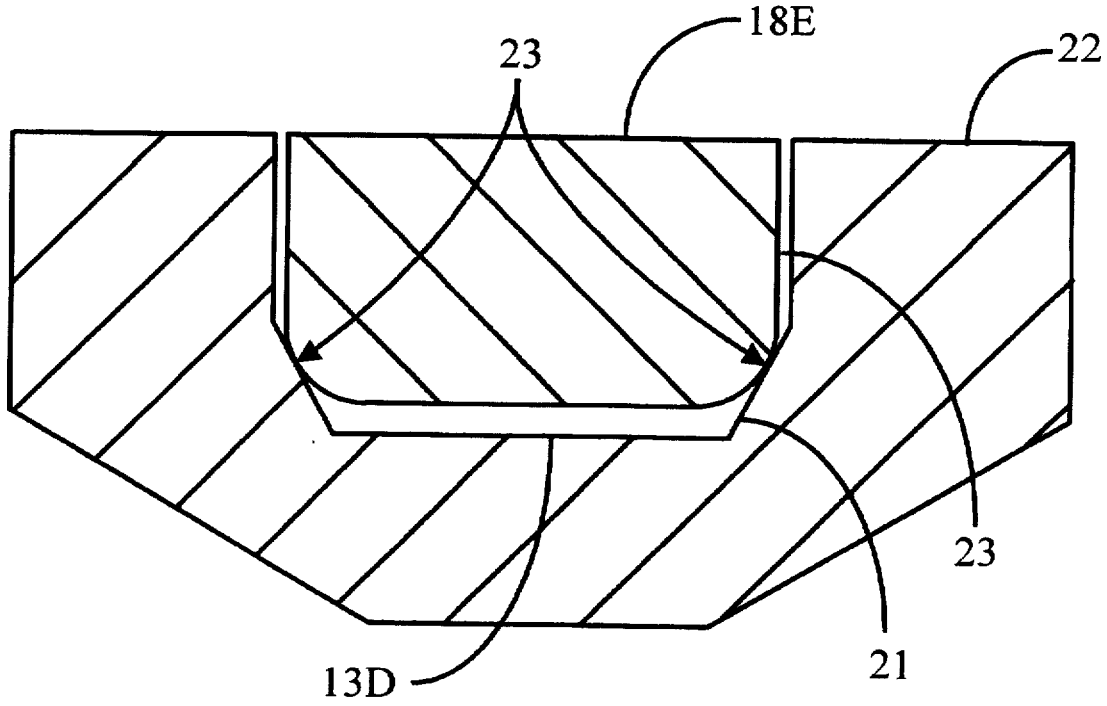

Shown in FIG. 11 is another embodiment of the invention, which uses the angular feature near the bottom of the mitre bar and groove.

DESCRIPTION OF THE PREFERRED EMBODIMENTS

Shown in FIG. 3 is a mitre bar 18A in accordance with a preferred embodiment of the invention. This spaced-apart view shows the relationship of the mitre bar 18A with the mitre guide 17 to be conventional. The mitre guide 17 is attached to the mitre guide via a pivot pin 33, and shims 31 are used to adjust the height of the guide above the mitre bar 18A, so that the guide is at the proper height relative to the table top. Unlike the conventional mitre bar, however, in this embodiment the mitre bar 18A has a cross-section which corresponds to a segment on the cord of a circle. The purpose of this shape can be seen in FIG. 4. As shown there, in accordance with a preferred embodiment of the invention, the mitre groove 13A has a cross-section that is trapezoidal in shape. The segment-shaped mitre bar 18A is configured in size to sit down into the groove as illustrated in FIG. 5. This is accomplished by ensuring that the length, L, of the chord of the circle forming mitre bar 18A is shorter than the width of the top of the groove. In this way, the bar is always below the top of table saw, and out of the way of workpieces being cut on tablesaw top. Also, in the preferred mode, the depth of mitre bar 18A is less than the depth of the groove, so that the bar essentially hangs in groove 13A without touching the bottom, but instead touches the sides of the groove along the parallel lines 5A and 5B which run the length of the groove (shown as points 5A and 5B, in FIG. 5, since the lines would be into the paper). This configuration assures constant contact with groove 13A as the bar is moved along it, eliminating the play introduced when using bars and grooves of rectangular cross-section.

FIG. 6 shows a second embodiment of the invention, in which a mitre bar 18B has a trapezoidal cross-section as well as the groove 13A. There, the two trapezoids have dissimilar angles, and the width of the top of the trapezoid of mitre bar 18B is smaller than the width of the top of the trapezoid of the groove 13A. Also, the depth of the bar 18B is less than the depth of the groove 13A, so that the bar again hangs in the groove, and touches the sides along two parallel lines 6A and 6B running the length of the groove 13A.

FIG. 7 shows a third embodiment of the invention that has a mitre groove 13B which is also a segment on the chord of a circle. In this embodiment, it is preferred to use the mitre bar 18A which is also the segment on a chord of a circle. Similar to the first embodiment, the length of the chord of the mitre bar 18A is shorter in length than the chord of mitre groove 13B. Also, in this instance the depth of the mitre bar 18A should not be deeper than the depth of the groove 13B. This can be accomplished choosing the radius of the mitre bar 18A to be larger than the radius of the groove 13B. Those skilled in the art will also realize that other shapes could also be used for the mitre bar. For example, the mitre bar could again be trapezoidal, provided it was narrow enough at the bottom to clear the sides of the groove.

FIG. 8A shows a fourth embodiment of the invention in which a mitre bar 18C has a triangular cross-section, which is in contact at its apex with a mitre groove 13C which is also a triangle. In this embodiment, the apex of the mitre bar rests on the apex of the mitre groove. In the preferred mode, the shims are used to adjust the mitre bar so that one entire side of its triangular cross-section rests against the groove. Hence, in this embodiment, there are an infinity of parallel lines at which the bar is in contact with the groove. If however, the alignment using the shims is not well done, there will be only one line of contact, i.e.. at the apex of the groove. Those skilled in the art will also realize that one could use a triangular groove 13C with a trapezoidal bar such as 18B that hangs in the groove just as in the case of a trapezoidal groove, as illustrated in FIG. 8B. Similarly, one could use a triangular groove and a triangular mitre bar 18D where the bar hangs in the groove as in the previous embodiments, by making sure that the angle A of the apex of the mitre bar 18D is greater than the angle B of the apex of groove 13C as shown in FIG. 8C.

FIG. 9 shows two alternative embodiments of an after-market insert with can be used with a standard tablesaw table. There, and insert 91 is placed inside a standard groove 13. In one embodiment, the insert has a trapezoidal cross-section as shown. In another embodiment, it has a triangular cross-section as illustrated by the dotted lines 92. The insert with the trapezoidal cross-section can be used with the mitre bar 18B having a trapezoidal cross-section described above, or with the mitre bar 18A which is a segment on the chord of a circle. Similarly, the insert which has a mitre groove with a triangular cross-section can be used with the mitre bar 18C having a triangular cross-section. Similarly, FIG. 10 shows an insert 93 having a groove 13C which is the segment of a chord of a circle, as in the embodiment described with reference to FIG. 7. With this latter embodiment, mitre bar 18A would be used. In the typical case, inserts 91, 92 and 93 are constructed of a hard plastic or extruded metal, and are cut to fit securely in the standard mitre groove 13. In the preferred mode, the insert is secured to the standard groove by cement, or glue.

Figure 1:
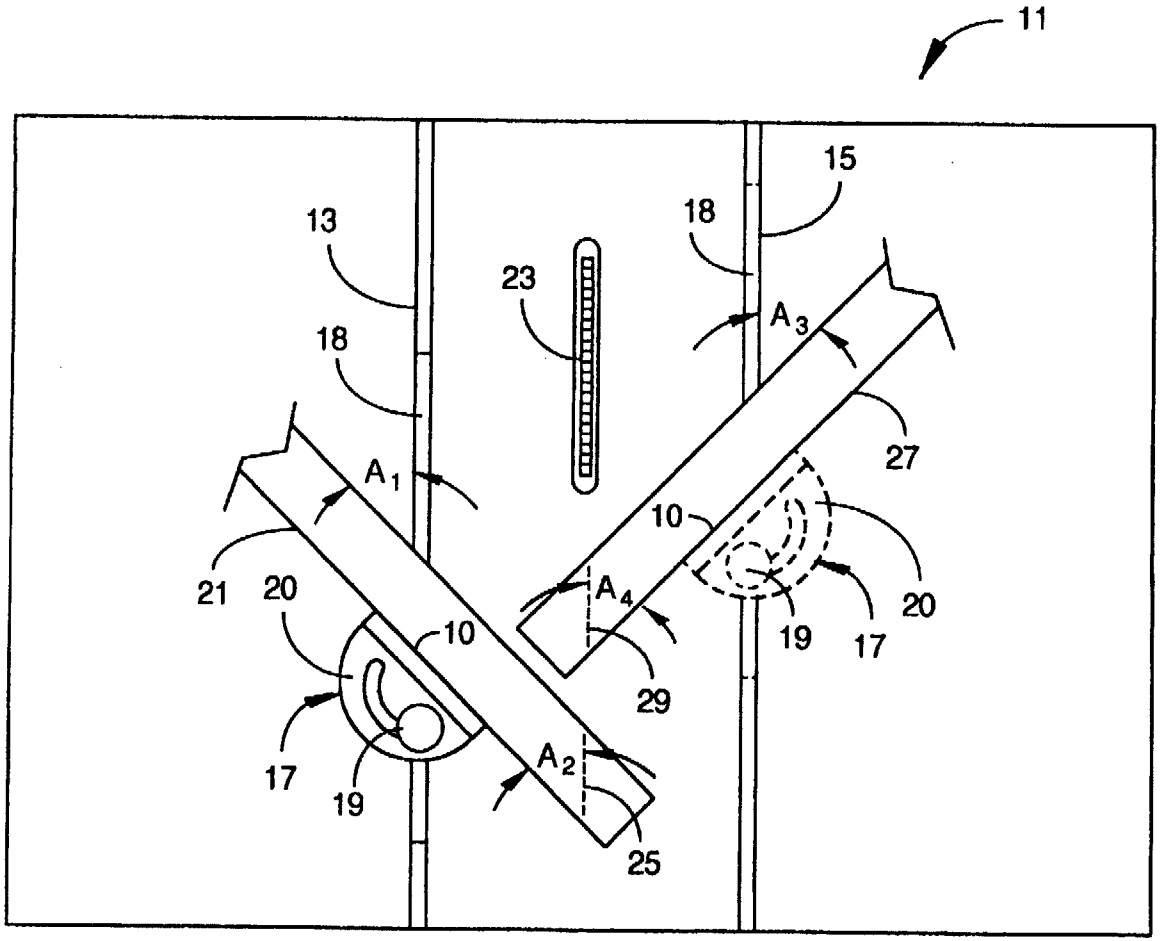
Fig. 1 Prior Art
Figure 2:
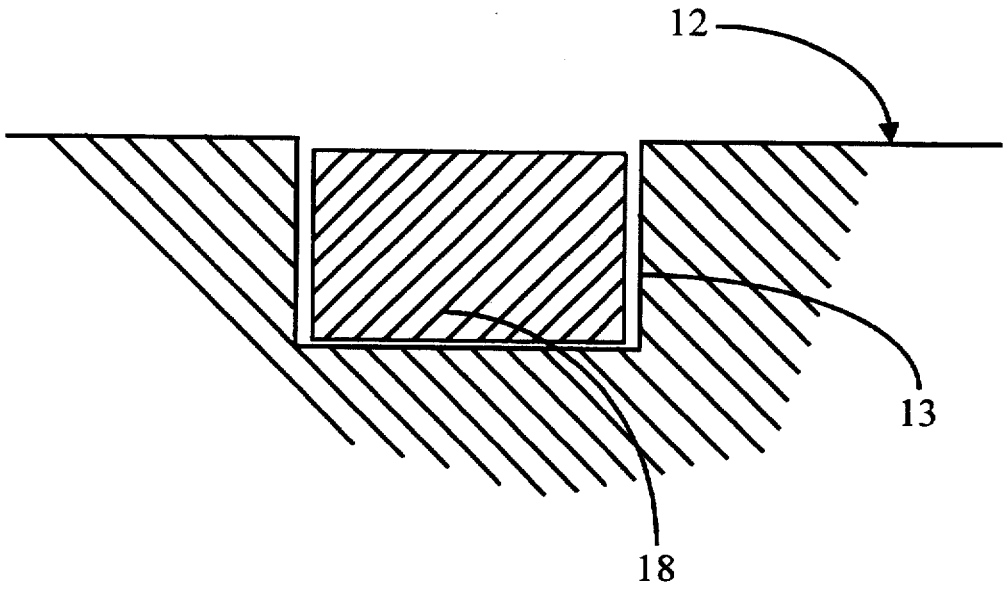
Fig 2 (prior Art)

Illustrated in FIG. 1 is a cross-sectional view of yet another embodiment of the invention. A tablesaw top 22, has a groove 13D, which has vertical sides 23, with an angular cut 21 near the bottom, and a flat bottom as in a normal mitre groove. In the preferred mode, angular cut 21 is about 45 degrees from vertical, however, the particular angle is not critical to the working of the invention. Mitre bar 18E resembles a normal mitre bar having a rectangular cross-section, except the bottom corners 23 have been rounded so as to touch angular cut 21 along one tangent line at each side. (The tangent line is orthogonal to the paper.) The purpose of the this embodiment, is to look as much like a normal mitre bar and groove as possible, and still accomplish the function of the invention.

Those skilled in the art will appreciate the fact that these geometries are quite easily constructed. More importantly, the tolerances for constructing these various grooves and bars can be quite loose, since the operation of the combination of groove and bar does not require precision machining to achieve the desired result. This relaxation of tolerances means that these devices can be manufactured quite inexpensively, probably at substantially the same cost as in the standard rectangular bar and groove combination.

Those skilled in the art will appreciate that there are many variations which could be made to these which would fall within the concept of the invention. For example, instead of the segment of a chord of a circle for the shape of the groove or mitre bar, one could use a segment of some other arc, for example a parabola or hyperbola, or even an ellipse. Also, one skilled in the art will realize that in designing the shapes to be used, that the shapes have been chosen for simplicity and for ease of manufacture. One could have used a much more complicated overall shape than a trapezoid, for example. However, as long as the width of the top of the groove is larger in dimension than its width at a point lower in the groove, and the groove is progressively getting narrower as one moves down into the groove, there is an opportunity for a mitre bar to be used which hangs in the groove at a height above the bottom which is stable to motion along the groove. Those skilled in the art will realize however, that shape of the groove below the points (lines) of contact of the mitre bar with the groove is irrelevant. Essentially, below the point of contact of the mitre bar with the groove, the groove could increase in size, or be just about any other shape. Such other shapes, however, would likely be more difficult to construct. Those skilled in the art will also realized that there are also many different combinations of shapes which will fall within the concept of the invention. For example, one could use a triangular groove with the trapezoidal mitre bar or the mitre bar having the shape of a segment of a chord of a circle. Also, even a standard mitre bar having a rectangular cross-section could be used with the triangular or trapezoidal groove. Similarly, it should be apparent that it is not necessary in the case of a trapezoidal mitre bar that the contact points (lines) of the bar with the groove be at the top of the mitre bar as in the previous embodiments. Rather, instead, the contact points (lines) could be at the bottom of the mitre bar as in the case of a rectangular bar. Those skilled in the art will also realize that the teachings of this invention apply to types of saws other than table saws. For example, the invention would be useful for band saws as well, and for most types of saws where a mitre bar and guide can be used.

I claim:

1. Apparatus comprising:

a flat saw table having a top with a groove therein extending substantially across said table top, said groove being defined by an open top and a bottom surface, wherein said groove has a cross-section which is wider at the top than at a point located on the bottom surface below the top of said groove;

a mitre bar for use with said table top, said mitre bar having a top and a bottom, wherein the width of the top of the mitre bar is smaller in dimension than the width of the top of the groove, such that the mitre bar will sit in said groove without extending beyond the table top, and the mitre bar is configured to contact the groove along only two horizontal parallel straight lines running the length of the groove along the groove bottom surface;

and wherein each of said two parallel straight lines is at a location in the groove spaced from a lowest point of the bottom surface.

2. Apparatus as in claim 1 wherein said mitre bar contacts said two parallel straight lines at the top of said mitre bar.

3. Apparatus as in claim 1 wherein the groove has a cross-section which is trapezoidal in shape.

4. Apparatus as in claim 3, wherein said mitre bar also has a cross-section which is trapezoidal shape.

5. Apparatus as in claim 4, wherein the mitre bar is configured to contact said groove at the top of said mitre bar.

6. Apparatus as in claim 3 wherein said mitre bar has a cross-section which is a segment on a chord of a circle.

7. Apparatus as in claim 1 wherein said groove has a cross-section which is a segment on a chord of a circle.

8. Apparatus as in claim 7 wherein said mitre bar has a cross-section which is a segment on a chord of a second circle, wherein said second circle has a larger diameter than said circle.

9. Apparatus as in claim 7 wherein said mitre bar has a cross-section that is trapezoidal.

10. Apparatus as in claim 1 wherein said groove has a cross-section which is a triangle, wherein said triangle has its apex at the bottom of said groove.

11. Apparatus as in claim 10 wherein said mitre bar has a cross-section which is triangular with its apex at the bottom of said mitre bar.

12. Apparatus as in claim 11, wherein said mitre bar rests in said groove with the apex of said mitre bar above the apex of said groove.

13. Apparatus as in claim 1 further comprising:

a slot in said table top for a saw blade to extend therethrough, said slot spaced apart from said groove and substantially parallel to said groove.

14. Apparatus as in claim 13 wherein the groove has a cross-section which is trapezoidal in shape.

15. Apparatus as in claim 13 wherein said groove has a cross-section which is a segment on a chord of a circle.

16. Apparatus as in claim 13 wherein said groove has a cross-section which is triangular.

17. Apparatus as in claim 1 wherein said mitre bar has a constant cross-section groove.

18. Apparatus as in claim 17 wherein said cross-section comprises a trapezoidal in shape.

19. Apparatus as in claim 17 wherein said cross-section comprises a triangular shape.

20. Apparatus as in claim 17 wherein said cross-section comprises a shape which is a segment on a chord of a circle.

21. Apparatus as in claim 17 further comprising a mitre guide attached to said bar.

* * * * *